US005749492A

United States Patent [19]

Petterson

[11] Patent Number: 5,749,492

[45] Date of Patent: May 12, 1998

[54] SHEET DISPENSER AND METHOD

[76] Inventor: Tor Petterson, 96 Yacht Harbor Dr., Rancho Palos Verdes, Calif. 90274

[21] Appl. No.: 433,978

[22] Filed: May 4, 1995

[51] Int. Cl.[6] ..... A47K 10/24

[52] U.S. Cl. ..... 221/1; 221/44; 221/45; 221/62

[58] Field of Search ..... 221/44, 45, 46, 221/61, 62, 63, 304, 1; 206/409; 242/593

[56] References Cited

U.S. PATENT DOCUMENTS

| | | | |
|---|---|---|---|
| 4,262,816 | 4/1981 | Margulies | 221/46 |
| 4,462,507 | 7/1984 | Margulies | 221/63 |
| 5,205,455 | 4/1993 | Moody | 225/106 |
| 5,211,308 | 5/1993 | Decker et al. | 221/63 |
| 5,246,137 | 9/1993 | Schutz et al. | 221/44 |
| 5,310,083 | 5/1994 | Rizzuto | 221/63 |
| 5,346,064 | 9/1994 | Rizzuto | 206/409 |
| 5,370,338 | 12/1994 | Lewis . | |

FOREIGN PATENT DOCUMENTS

| | | | |
|---|---|---|---|
| 646471 | 1/1992 | Australia | 221/45 |
| 0117074 | 1/1984 | European Pat. Off. . | |

*Primary Examiner*—F. J. Bartuska
*Attorney, Agent, or Firm*—Sheldon & Mak; Denton L. Anderson

[57] ABSTRACT

A Sheet Dispenser for dispensing of flexible and foldable sheets, such as paper towels and the like from a center fed roll thereof. The Sheet Dispenser of the present invention relies upon a member, such as a plate, which may be in the form of or part of a housing for holding the roll of sheets. The plate member is provided with a lower circular dispensing aperture for receiving a leading strip of the sheets from the center fed roll such that a user may grasp and pull outwardly on the sheets in order to achieve a dispensing of the same. The invention relies upon an opening, such as an elongate slot formed in the plate member and in communication with the dispensing aperture and which allows a leading portion of the sheets to be inserted through the slot and into the dispensing aperture. This construction overcomes the previous problems of feeding a leading strip of the successive sheets in the dispensing aperture. In a preferred embodiment, the dispensing aperture, in combination with the opening, form an elongate dispensing aperture and the size of the elongate dispensing aperture is adjustable in order to accommodate different thicknesses, sizes and physical characteristics of differing sheet materials which can be dispensed.

22 Claims, 3 Drawing Sheets

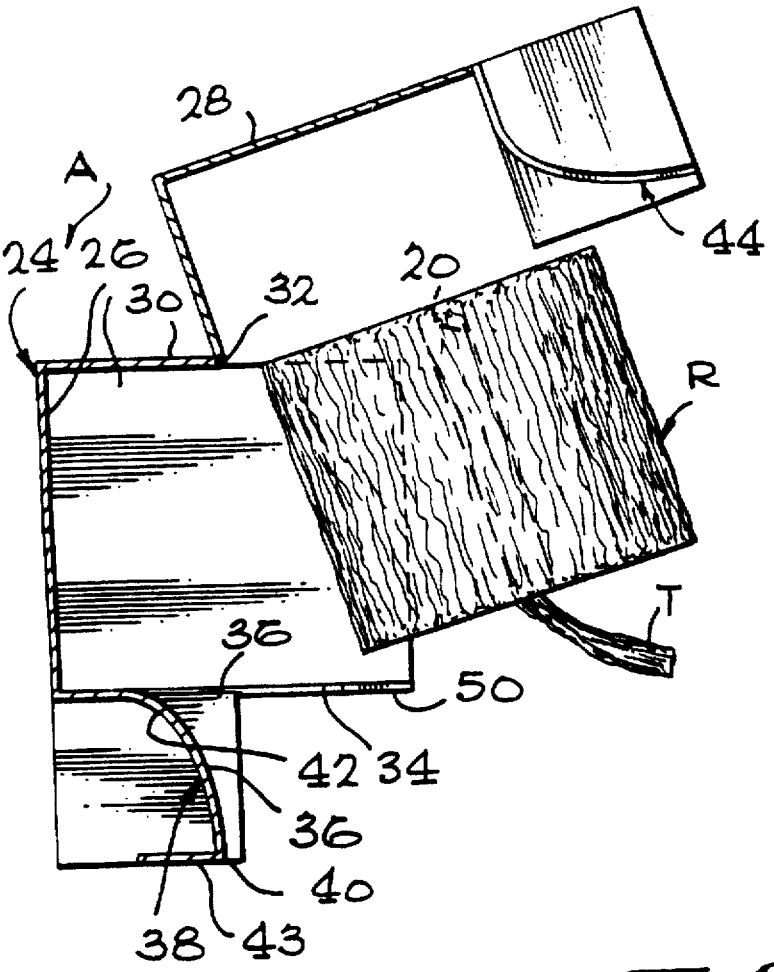
FIG. 1
FIG. 2
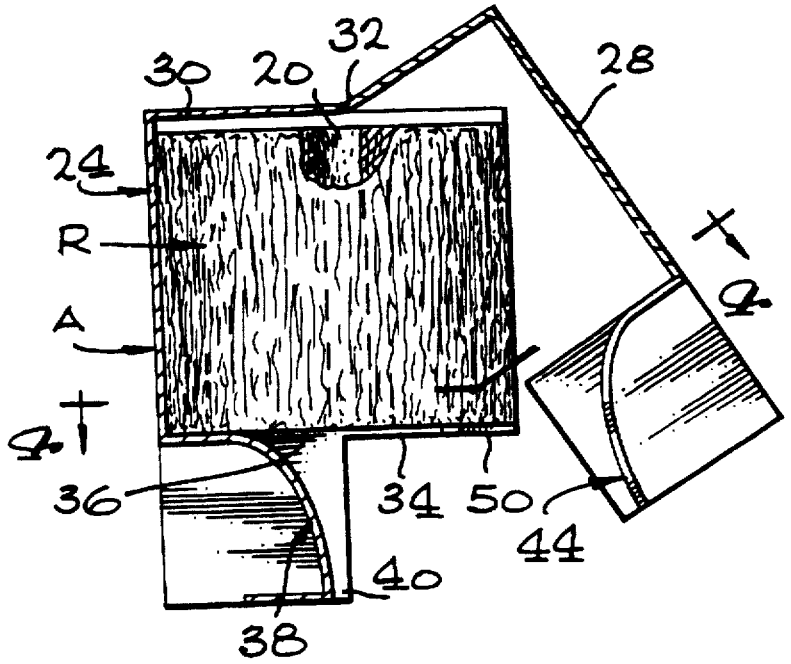

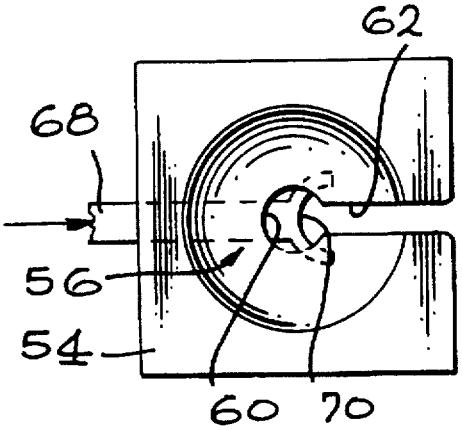
FIG. 6
FIG. 7
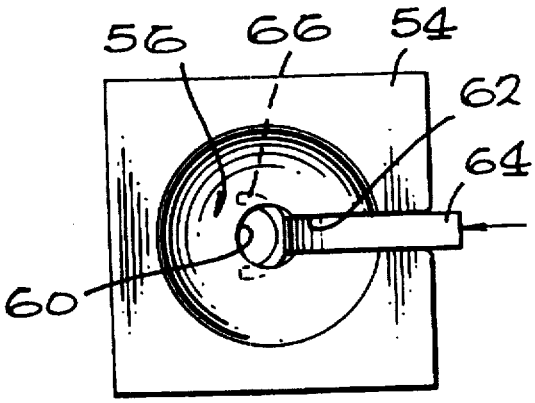
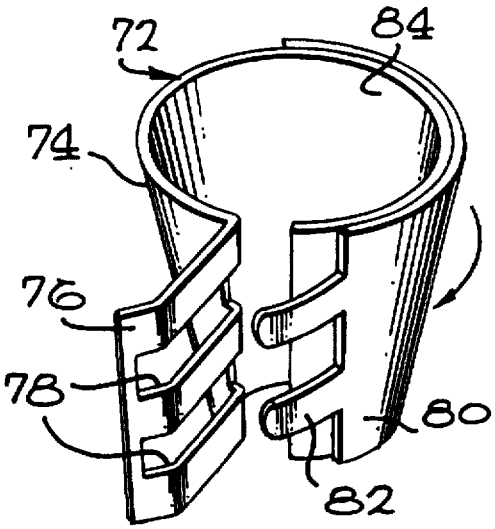
FIG. 8
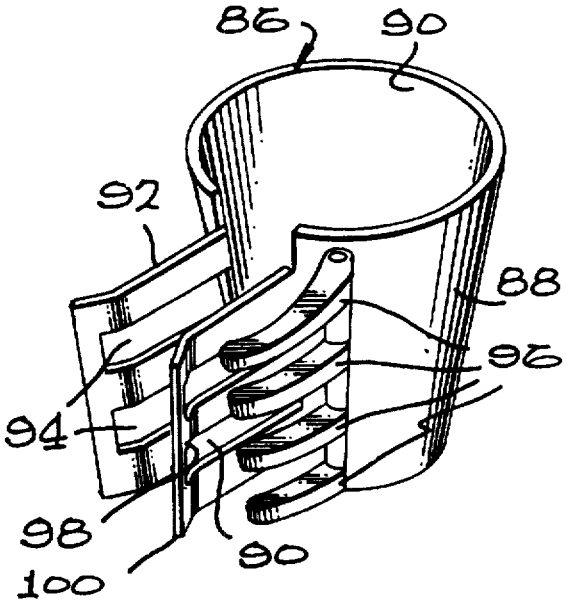
FIG. 9

SHEET DISPENSER AND METHOD

BACKGROUND OF THE INVENTION

1. Field of the Invention

This invention relates in general to certain new and useful improvements in flexible and foldable sheet material dispensers, and more particularly, to sheet dispensers which are capable of easily threading a leading strip or sheet into a dispensing aperture from a center fed roll of thereof in the dispenser.

2. Brief Description of the Related Art

For several years, there have been dispensers available in which flexible sheet materials, such as paper towels are mounted in a large roll of such towels and with each of the individual towels being dispensed from the roll through the dispenser. Rolls of similar sheet materials, such as facial tissues and the like, are also capable of being dispensed from coreless, center-fed rolls. The same holds true of baby tissues such as those commonly referred to as baby wipes.

In each case, the individual sheet segments forming the roll are separated from one another by score lines or the like. In many cases, the paper towels or other sheets are formed on a large roll and are separated by merely tearing the same along a severing blade on the dispenser. Several of these dispensers rely upon the use of center-fed rolls, that is, where the sheets are literally fed from the center of the roll as opposed to being pulled tangentially from the exterior of the roll.

Dispensing of other forms of sheet materials, such as facial tissues and the like, from center-fed rolls are similar to the dispensing of paper towels. In each case, the problems encountered with dispensing sheet material from center-fed rolls are similar. However, the above problems in dispensing of paper towels is exemplary of the limitations of the center-fed sheet dispensers, regardless of the precise sheet form which is being dispensed.

There are several proposed and commercially available paper towel dispensers and which all rely upon supporting a roll of the paper towels on or with respect to a support plate which may form part of an outer housing and with a dispensing aperture in the plate member to enable a dispensing of a leading strip at the beginning or lead portion of the roll of paper towels through the dispensing aperture. However, the dispensing aperture is usually fairly small, having a diameter of perhaps no more than about ⅜ inch, in order to impose sufficient friction on the towels or other paper sheets which are dispensed. In this way, one dispensed sheet can be separated from the next dispensed sheet.

However, the very small size of this dispensing aperture makes it difficult for attendants to install a new roll of paper sheets and to feed the leading strip through the dispensing aperture thereof. Due to the fact that there is often some difficulty in feeding the leader portion of the paper sheets through the open dispensing aperture, the attendant who is installing a new roll or to re-feeding an existing roll, attempts to use an implement such as a pencil or pen to aid in pushing the leader portion of the center fed roll through the feed aperture. Not only is this cumbersome and time consuming, but it can often times result in injury to the attendant if the attendant is not particularly careful with the pointed implement.

In addition to the foregoing, there is no means to adjust the size of the feed aperture to accommodate a particular sheet condition or a particular sheet thickness. For example, in many cases, baby wipe tissues are often times dispensed in a damp condition. Consequently, due to the fact that they are damp, only a minimal amount of friction by the dispenser is required to separate one baby wipe tissue from the next successive baby wipe tissue. In other cases, and due to the thickness of the sheet, it is desirable to vary the amount of frictional force imposed on the sheets passing through the dispensing aperture. Heretofore, there has been no effective means of adjusting the size of this opening.

Representative of the prior art devices which disclose center fed paper towels are U.S. Pat. No. 5,310,083 dated May 10, 1994, U.S. Pat. No. 5,205,455 dated Apr. 27, 1993, and U.S. Pat. No. 5,346,064 dated Sep. 13, 1994. However, all of these dispensers are clearly representative of the prior art in that they have a fixed sized feed aperture with no means for easily enabling the feed of a leader strip of the sheet material through the feed aperture.

OBJECTS OF THE INVENTION

It is, therefore, one of the primary objects of the present invention to provide a flexible and foldable non-metallic sheet material dispenser which allows dispensing of sheets from a center fed roll thereof and which permits adjustably controlling the size of a dispensing opening forming part of such dispenser.

It is another object of the present invention to provide a sheet dispenser of the type stated which comprises a plate member for receiving a roll of center fed sheets in a selected position and which allows dispensing outwardly through a dispensing aperture in the plate member.

It is a further object of the present invention to provide a dispenser of the type stated in which the size of the dispensing aperture may be selectively adjusted by means of a manually positionable element controllable by an operator of the device.

It is an additional object of the present invention to provide a sheet dispenser of the type stated which can be constructed at a relatively low cost but which is highly efficient in operation.

It is another salient object of the present invention to provide a method of dispensing flexible and foldable non-metal sheets from a center fed roll thereof and which permits easy feeding of a leading strip of the sheets through a dispensing aperture.

With the above and other objects in view, my invention resides in the novel features of form, construction, arrangement and combination of parts and components presently described and pointed out in the claims.

SUMMARY OF THE INVENTION

This invention relates in general to a dispenser for the dispensing of individual sheets of a sheet product from a center fed roll of the product. The center-fed roll of the sheet product is necessarily a coreless roll which enables the removal of sheets from the center portion thereof. These sheets are all formed of a flexible and foldable material and preferably are a fibrous sheet which encompasses at least fabric materials, both synthetic and natural, and paper and paperboard product materials. Thus, the sheets which are dispensed from the dispenser of the invention are non-metallic. One of the most common type of sheet which is dispensed with the dispenser of the present invention is a paper sheet material as for example, paper hand towels, facial tissues, various so-called "toilet tissues", baby cleansing tissues, and the like.

The paper or other fibrous product is generally in the form of individual sheets which may be scored or are capable of being separated from a next adjacent sheet by means of a perforated line or the like.

The dispenser of the present invention comprises a plate member for supporting or receiving the roll of the sheet product in a selected positions, such as an upright position. A dispensing aperture is formed in the plate member and positioned in alignment with the central opening of the roll for receiving the sheets of the sheet product in a form where they are initially connected to one another. In this way, an operator of the dispenser can pull outwardly on the leading sheet fed through the dispensing aperture in order to obtain a dispensing of the sheet.

In one of the important aspects of the present invention, an opening such as a slot is formed in the plate in communication with the aperture. This enables the formation of a larger dispensing aperture such that the initial leading strip of the sheet material can be fed through the opening and into the aperture in order to start a feeding thereof.

In effect, the elongate slot or other opening and the initial aperture in the plate member form an elongate dispensing aperture. Further, means is provided with the support plate to selectively control the size of the dispensing aperture. In this way, it is possible to enable accommodation of paper sheets with differing thickness or with differing moisture conditions or the like.

The actual dispensing aperture in accordance with the present invention usually is formed through the plate member as aforesaid, and comprises a first opened end for receiving the sheet material. The aperture has a second opened end which is small than the first for dispensing the sheet material. Typically, the sheet material is inserted sideways into the aperture without necessarily threading the sheets initially through the aperture which was required in each of the prior art structures. Thereafter, the size of the aperture can be selectively controlled.

It is important to provide a proper amount of friction on the individual sheets as they are pulled through the dispensing aperture so as to allow one sheet on the roll to be severed from the next above sheet. However, the amount of frictional force provided by the dispensing aperture would need to be varied in accordance with the thickness or the conditions of the individual sheets. For example, in cases of paper towels having some dampness or entrained water, lesser amount of friction and hence a larger aperture could be employed. The aperture control means allows the selective control of the size of the aperture.

An element is shiftable with respect to the plate member to selectively cover or expose a portion of this dispensing aperture. In a preferred embodiment, the plate member may form part of a housing which stores and holds a vertically positioned roll of paper towels. An openable cover plate forms part of the housing and is openable and closable with respect to the housing in order to provide access to the interior thereof.

The aperture control means can be mounted on the cover plate and movable with respect to the dispensing aperture when the cover plate is moved with respect to the housing. In another embodiment, the aperture control means is an element shiftable on the plate with respect to the dispensing aperture to control the size thereof. The present invention also provides a unique method for dispensing individual sheets in the dispenser.

This invention possess many other advantages and has other purposes which will become more fully apparent from a consideration of the forms in which it may be embodied. A few practical embodiments of the dispenser and the method of using the same are illustrated in the accompanying drawings and described in the following detailed description. However, it should be understood that these drawings and the detailed description are set forth only for purposes of illustrating the general principles of the invention in are not to be taken in a limiting sense.

BRIEF DESCRIPTION OF THE DRAWINGS

Figure 3:
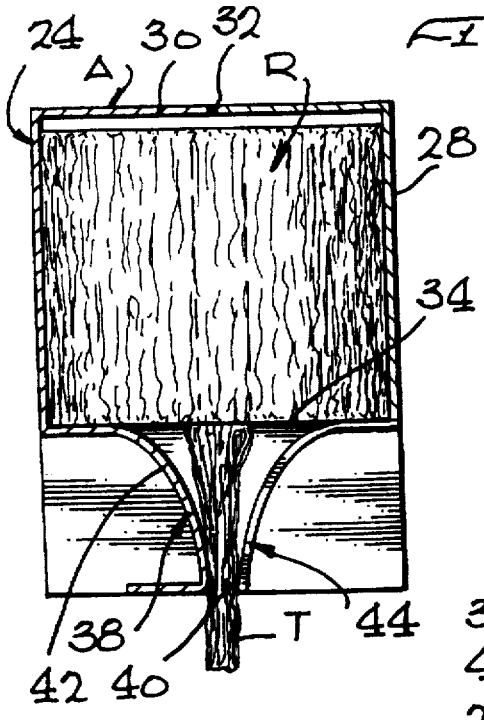
Figure 4:
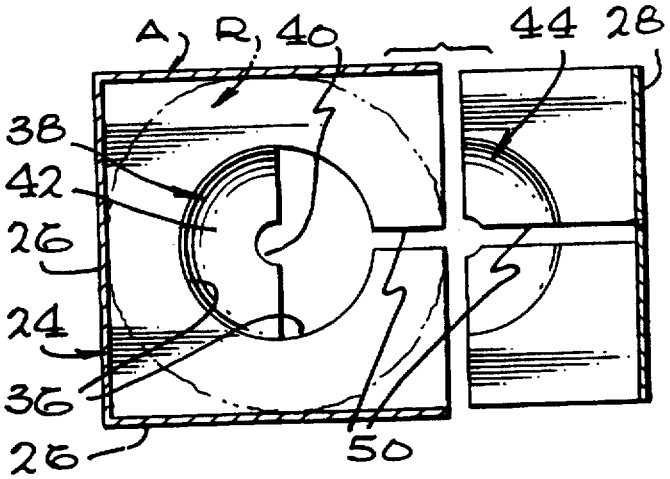
Figure 5:
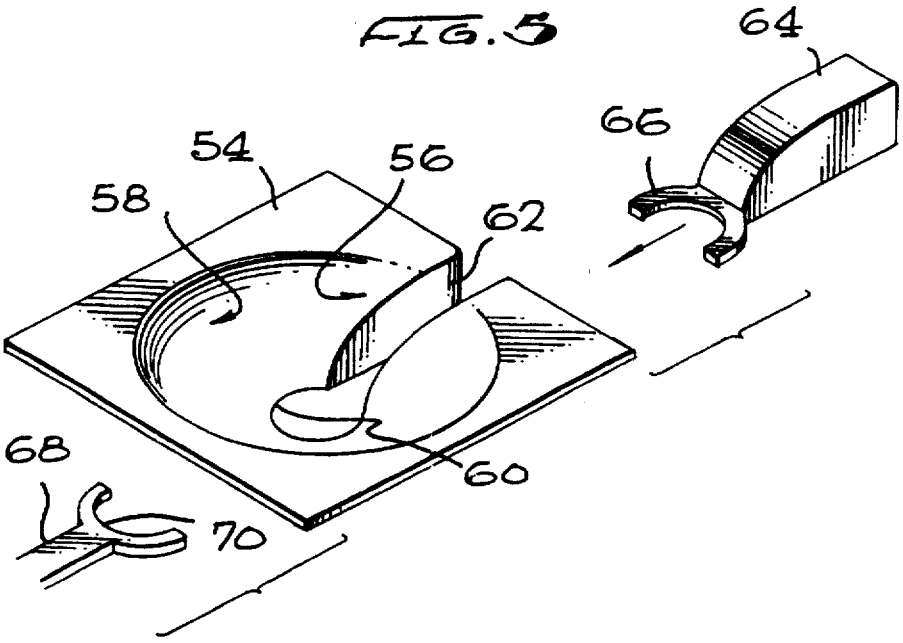

Having thus described the invention in general terms, reference will now be made to the accompanying drawings in which:

FIG. 1 is a side elevational view, partially in the section of a center fed paper towel dispenser constructed in accordance with and embodying the present invention;

FIG. 2 is a vertical sectional view somewhat similar to FIG. 1 and showing a cover forming part of the dispenser in a partially closed position;

FIG. 3 is a vertical sectional view, similar to FIGS. 1 and 2, and showing the dispenser in a fully closed position with a center fed roll of paper towels disposed therein;

FIG. 4 is a horizontal sectional view taken along line 4—4 of FIG. 2;

FIG. 5 is a schematic prospective view showing a modified form of paper towel dispenser constructed in accordance with and embodying the present invention;

FIG. 6 is a top plan view of a portion of the dispenser of FIG. 5 and showing a positioning of a left-hand aperture central member;

FIG. 7 is a bottom plan view of the embodiment of FIG. 5 and showing a positioning of a right-hand aperture control member;

FIG. 8 is a perspective view of a further modified form of dispensing mechanism and particularly showing a dispensing aperture control means; and FIG. 9 is a perspective view of another embodiment of a dispenser in accordance with the present invention and particularly showing another modified form of aperture control means.

DETAILED DESCRIPTION OF PREFERRED EMBODIMENTS

Referring now in more detail and by reference characters to the drawings, A designates a sheet dispenser for dispensing individual sheets from a roll R thereof. For purposes of illustrating the general principles of the invention and describing the details of operation of the dispenser, this dispenser will be described in connection with dispensing individual paper towels T from a center-fed roll thereof. However, it is to be understood that the invention is obviously applicable to other forms of paper sheet products or other non-paper sheet products. In general, any type of non-metallic fibrous sheet product which is flexible and foldable can be dispensed from the dispenser of the present invention.

In the embodiment of the invention as illustrated, the roll R is coreless and contains a central bore 20 through which paper towels T are initially dispensed. Moreover, and by reference to FIGS. 1 and 2 of the drawings, it can be seen that the roll R is essentially vertically positioned. However, in the case of dispensing of baby wipes from a baby wipe canister, the sheets would be pulled upwardly. In the case of hospitals and various industrial uses, the individual sheets are often pulled from the side of the dispenser. For commercial use, such as in gas stations and restaurants, paper towels are typically pulled downwardly.

The paper towel dispenser A is generally comprised of an outer housing 24 having of a partially enclosing side wall 26. In this case, the side wall extends about three sides of the housing. A closure member 28 is hingedly connected to the top wall 30 of the housing by means of a hinge 32, as best shown in FIG. 1. In accordance with this construction, the closure member 28 is shiftable upwardly to an open position and downwardly to a closed position, as best shown in FIG. 3. When in the closed position, this closure member 28 will thereupon constitute the fourth wall of the rectangularly shaped housing 24.

One of the important aspects of the dispenser A is the fact that the housing 24 includes a support plate 34 for supporting a vertically positioned roll of center fed paper towels T. Inasmuch as the plate 34 receives a vertically disposed roll of the sheet material, the plate is typically referred to as support plate. However, it should be understood that the dispenser A of the invention operates equally as well when the roll is positioned such that its elongate opening is horizontally arranged for sideways feeding or when the sheets are dispensed through an upwardly opening dispensing aperture and pulled upwardly from the dispenser.

The support plate 34 is provided with an enlarged open upper end 36 constituting a part of a downwardly opening somewhat funnel-shaped dispensing aperture 38. The dispensing aperture 38 also has a lower opened end 40. In this respect, and in a preferred embodiment, the dispensing aperture 38 is somewhat conically shaped and provides a circularly shaped upper opening 36 and a circularly shaped lower opening 40. However, the lower opening 40 is substantially diameterally reduced compared to the open upper end 36.

While the dispensing aperture is frustro-conically shaped in a preferred embodiment, it should be understood that this type of opening is not absolutely necessary in connection with the present invention. It is possible to use, for example, a cylindrically shaped aperture in which both the upper and lower ends have essentially the same diameter and which has a generally constant diameter throughout. However, the conically shaped opening is preferred and is, of course, unlike the prior art devices which have a single aperture of constant diameter throughout.

It can be seen that the housing is constructed with an internally provided somewhat frusto-conically shaped wall 42 which forms the dispensing aperture 38 as shown and which terminates at a bottom wall 44 forming the lower end of the housing.

The frusto-conically shaped wall 42 is partially formed by an aperture control member 44 on the lower end of the closure member 28 and which, in effect, forms the upper open end 36 and the lower open end 40. The aperture control member 44 also comprises a portion of and effectively completes the frusto-conical wall 42. The aperture control member 44 could adopt other forms as hereinafter shown in more detail. However, in the embodiment as illustrated, the aperture control member 44 is formed at the lower end of the closure member 28 and constitutes the remaining portion of the frusto-conical wall 42. If the aperture control member 44 is not moved to its fully closed position, as shown in FIG. 3, then the dispensing aperture 38 would not be circularly shaped, but rather it would be somewhat elongate in this particular embodiment.

It can also be observed that the support plate 34 is effectively provided with an opening, such as an elongate slot 50, in communication with the dispensing aperture 38 and extending to the edge of the plate 34. It can be seen that the aperture control member has a portion which rides in the elongate slot and effectively reduces the size of the combined opening and dispensing aperture as the closure member 28 is moved to its fully closed position on the housing. The opening 50 and the dispensing aperture 38 effectively combine to form a somewhat elongate or larger dispensing opening. The size of this opening is controlled by positioning of the aperture control member 44.

As the aperture control member 44 is shifted closer to the original conically shaped dispensing aperture 38 in the plate 34 it will reduce the size of the opening 50 and also reduce the size of the ultimately formed dispensing aperture 36. Thus, when the closure member 28 is in the fully open position as shown in FIG. 1, the roll R paper towels T can be initially inserted from the edge of the plate 34 into the elongate slot 50. As the closure plate 28 is moved toward the closed position, it will start to reduce the size of the elongate slot and reduce the size of the enlarged opening until the cover member 28 is in the fully closed position, at which time the dispensing aperture 36 will adopt the shape and size as shown in FIG. 3.

The aperture control member 44 is dimensioned and shaped to fit snugly into the opening or slot in the support plate 34 and has an end portion which completes the frusto-conically shaped wall 42. This and portion may be in the form of a slot which receives the aperture control member, or it may have another shape. In any case, the slot or other form of opening is designed to effectively create a larger dispensing opening and a portion in communication with the edge of the plate to allow the leading strip of a roll of sheet material to be inserted through the slot from the edge of the plate and into the dispensing aperture. Nevertheless, when the closure member 28 is shifted to the closed position, the housing 24 will be sized to hold the coreless roll of sheet material. It is important to note that the dispensing aperture becomes cone-shaped such that the size is progressively reduced as the sheet is pulled downward. Moreover, the closure member 28, when in the fully closed position, will cause the aperture control means 44 to form the complete frustro-conically shaped dispensing aperture 36 and to retain the sheet material within the originally sized dispensing aperture 36.

It can be seen in accordance with the embodiment of the invention, as illustrated in FIGS. 1–4, that the critical components of the dispensing mechanism are the plate 34 position with respect to the desired orientation of the roll of sheet material, the dispensing aperture 36 formed in the plate and the opening 50 along with the aperture control means 44. With these components, it is possible to allow the initial leading strip of sheet material to be inserted into the slot or other form of opening 50 and moved sideways into the dispensing aperture 36. Thereafter, the overall size of the dispensing opening formed by the slot 50 and the dispensing aperture 36 is controlled by the aperture control means 44. In essence, the dispensing aperture can be viewed as having an opening in one side to allow the leading edge of the sheet material to be pushed sideways into the dispensing aperture and that the aperture control means 44 may constitute a plunger to enlarge or reduce the size of the dispensing aperture.

FIGS. 5–7 illustrate a modified embodiment of a dispenser for the dispensing of individual sheets of paper product or other sheet material from a center fed roll and which comprises a support plate 54 having a conically shaped dispensing aperture 56 therein. The dispensing aperture 56 has an opened upper end 58 at the upper surface of the support plate 54 and a diameterally reduced lower end 60 at the under surface of the support plate 54. In this way, the dispensing aperture 56 becomes conically shaped. An elongate slot 62 leads into the dispensing aperture and communicates with the side of the support plate 54 as best shown in FIGS. 5–7 of the drawings. In its simplest form, this support plate 54, as described, could constitute the dispenser of the invention with a roll of the center fed paper towels disposed on the upper surface thereof. The paper towels would again be fed into the elongate slot from the opened outer end of the slot and into the conically shaped dispensing aperture 56.

The dispensing aperture 56 can be adjustably sized by means of a first shiftable rod 64 on the right-hand side which is capable of shifting into the elongate slot 62. The shiftable rod 64 also has an arcuately shaped lower closure plate 66 capable of underlying the lower open end 60 and thereby reducing the size of the lower end 60 of the dispensing aperture 56. Thus, by controlling the position of the shiftable rod 64, it is possible to control the overall size of the lower open end 60.

In like manner, the size of the lower open end 60 can also be controlled by a similar shiftable rod 68 extendable from the opposite side of the dispensing aperture 56. In this case, the shiftable rod 68 carries an arcuatly shaped end section 70 which will also slide along the underside of the plate 54 and control the size of the lower open end 60 from the left as best illustrated in FIG. 6 of the drawings. These two shiftable rods 64 and 68 in combination thereby control the overall size of the lower open end 60. Moreover, the two shiftable rods cooperate with one another in order to effectively control the amount of friction imparted to the individual sheets as they are pulled through the dispensing aperture 56.

FIG. 8 illustrates another slightly modified form of sheet dispenser and particularly the dispensing mechanism thereof. In this case, the dispensing mechanism 72 of FIG. 8 would be mounted on the underside of a support plate such as the support plate 54 having one large opening therein. In this case, the dispensing mechanism 72 comprises a conically shaped wall 74 having an outwardly struck flange 76 with elongate recesses 78 formed therein. An arcuately shaped closure plate 80 is associated with the funnel shaped wall 74 and includes fingers 82 which are capable of fitting within the elongate slot 78. Depending upon the position of the fingers 82 in the elongate slot 78 the overall size of a dispensing aperture 84 formed by the conically shaped side wall 74 will be determined. Thus, if the fingers 82 are positioned close to the ends of the slot proximate to the conically shaped wall 74, then the size of the dispensing aperture is reduced. In like manner, if the fingers 82 are positioned closer to the outer ends of the slot 78, then the dispensing aperture 84 is larger.

FIG. 9 illustrates another modified form of a dispensing mechanism which would similarly be mounted on one side of a support plate. In this case, the dispensing mechanism 86 of FIG. 9 is comprised of a conically shaped side wall 88 forming a dispensing aperture 90. Again, a first end of the conically shaped wall 88 is provided with an outwardly struck flange 92 having a plurality of slots 94 formed therein. A plurality of hingedly mounted fingers 96 are formed on the opposite or seemed end of the conically shaped wall 88 and are adapted to be inserted into elongate slots 98 of a similar flange 100 on the second end of the conically shaped wall 88, as best shown in FIG. 4. Thus, when the fingers 96 are again inserted through each of the flange plates 92 and 100, they will control the overall size of the dispensing aperture 90.

Thus, there has been illustrated and described a unique and novel dispenser for the dispensing of a sheet product from a center fed roll of such product and which therefore fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A dispenser for the dispensing of individual sheets of a flexible and foldable sheet product from a center fed roll of such product, said dispenser comprising:

(a) a plate for receiving a roll of the sheet product in a selectable orientation;

(b) a dispensing opening provided by said plate positioned with respect to said roll for receiving the sheets of the product and allowing a user to pull the same outwardly through the opening;

(c) said opening in said plate being in communication with an outer edge of said plate allowing a strip of the sheets to be initially inserted from the outer edge of the plate and through the opening and into an inner portion of the opening to start the feeding through the dispensing opening thereof; and (c) closure means independent of said plate and movable with respect to said plate for closing said opening after insertion of the sheets into the opening to insure that the dispensing of the sheets occurs primarily through the inner portion of the dispensing opening.

2. The dispenser of claim 1 further characterized in that the center of the roll of said product as defined by an axial centerline passing through the roll is perpendicularly arranged to the plate.

3. The dispenser of claim 1 further characterized in that the sheet product is a fibrous sheet product.

4. A dispenser for the dispensing of individual sheets of a flexible and foldable fibrous sheet product from a center fed roll of such product, said dispenser comprising:

(a) a plate for receiving a roll of the sheet product in a selected orientation with respect to the plate;

(b) an opening in said plate positioned with respect to said roll for receiving the sheets of the product and allowing a user to pull the same outwardly through the opening;

(c) an elongate slot in said plate in communication with an inner portion of said opening and an edge of said plate, and said opening and slot forming an elongate dispensing aperture; and (d) aperture control means associated with said elongate dispensing aperture in said plate to selectively control the size of the elongate dispensing aperture to enable accommodation of sheets with different thickness or physical conditions.

5. The dispenser of claim 4 further characterized in that the aperture control means comprises an element shiftable with respect to said plate to selectively cover or expose a portion of the dispensing aperture.

6. The dispenser of claim 4 further characterized in that said plate forms part of a housing for storing the roll and that an openable cover member forms part of the housing.

7. The dispenser of claim 6 further characterized in that the aperture control means is mounted on said cover member and is moveable with respect to said elongate dispensing aperture when said cover member is moved with respect to the housing.

8. The dispenser of claim 6 further characterized in that the aperture control means is an element shiftable on said plate with respect to said elongate dispensing aperture to control the size thereof.

9. A dispenser for the dispensing of sheets of a flexible and foldable fibrous sheet product from a center fed roll of such product, said dispenser comprising:

(a) an outer housing sized to receive a center fed roll of said sheet product having a central bore;

(b) a cover member mounted on said outer housing and which is openable and closable to provide access to an interior of said housing;

(c) a plate forming part of said housing and being located with respect to the roll of the product in said housing and in a desired orientation;

(d) an aperture in said plate positioned generally perpendicularly with respect to the central bore of said roll for receiving the sheets of product and allowing a user to pull the same outwardly through the aperture;

(e) an opening in said plate in communication with said dispensing aperture allowing a strip of the sheets to be initially inserted through the opening and into the aperture to start the feeding thereof; and (f) aperture control means associated with said opening and aperture and being on said cover member to adjustably control the size thereof when said cover member is moved to an opened and closed position with respect to said housing in order to accommodate sheets of different thicknesses or physical conditions.

10. The dispenser of claim 9 further characterized in that said opening is a slot which is also in communication with an edge of said plate such that a strip of the sheets may be inserted through the slot at the edge of said slot and into an inner end of the aperture.

11. The dispenser of claim 9 further characterized in that the opening is a slot and the aperture and slot form an elongate dispensing opening and that the aperture control means comprises an element shiftable with respect to said plate to selectively cover or expose a portion of the elongate dispensing opening.

12. The dispenser of claim 11 further characterized in that the aperture control means is an element shiftable with respect to said plate and with respect to said elongate dispensing opening to control the size thereof.

13. The dispenser of claim 11 further characterized in that the sheet product is a fibrous sheet product.

14. A method of dispensing individual sheets of flexible and foldable fibrous sheet product in a dispenser from a center fed roll of such product, said method comprising:

(a) supporting a roll of the sheet product in a dispenser housing an in a position with respect to a generally flat surface;

(b) inserting a strip of the sheet product through an elongate dispensing aperture in said surface positioned with respect to said roll such that the elongate dispensing aperture receives the sheets of the roll;

(c) moving a closure member on said housing to a closed position to close said housing;

(d) adjustably controlling the size of the elongate dispensing aperture in said surface in response to the moving of the closure member to the closed position to provide the proper amount of friction in the sheets to thereby allow the sheets to be initially inserted into the aperture to start the feeding thereof and to enable pulling and dispensing of individual sheets of the product; and (e) allowing a user to pull the sheets outwardly through the aperture to achieve a dispensing thereof.

15. The method of claim 14 further characterized in that the method comprises shifting an element on said closure member with respect to said generally flat surface to selectively cover or expose a portion of the dispensing aperture.

16. The method of claim 15 further characterized in that the method comprises initially inserting a strip of the sheet product through an elongate slot which is also in communication with an edge of the generally flat surface and the dispensing aperture.

17. A dispenser for the dispensing of individual sheets of a flexible and foldable fibrous sheet product from a center fed roll of such product, said dispenser comprising:

(a) an outer housing sized to hold a roll of the sheet product;

(b) a plate forming part of said housing for receiving a roll of the sheet product in a selected orientation with respect to the plate;

(c) a dispensing aperture in said plate positioned with respect to said roll for receiving the sheets of the product and allowing a user to pull the same outwardly through the aperture;

(d) a closure member forming part of and on said housing and being movable with respect to said housing; and (e) aperture control means shiftable with respect to said plate to control the size of the dispensing aperture and fully enclose same after sheets have been entered into the aperture.

18. The dispenser of claim 17 further characterized in that the aperture is elongate and the aperture control means comprise an element on said cover member shiftable with respect to said plate to selectively cover or expose a portion of the aperture.

19. The dispenser of claim 17 further characterized in that the dispensing aperture forms part of an elongate slot which is also in communication with an edge of the plate.

20. A dispenser for the dispensing of individual sheets of a flexible and foldable sheet product from a center fed roll of such product, said dispenser comprising:

(a) an outer housing;

(b) a plate in said housing for receiving a roll of the sheet product in a selectable orientation;

(c) a dispensing aperture provided by said plate positioned with respect to said roll for receiving the sheets of the product and allowing a user to pull the same outwardly through the aperture;

(d) an opening in said plate in communication with said aperture and in communication with an outer edge of said plate and exteriorly of a portion of the housing allowing a strip of the sheets to be initially inserted from the outer edge of the plate and through the opening and into the dispensing aperture to start the feeding through the dispensing aperture such that an endless length of the roll of the sheets can be introduced into said opening directly from the exterior of the housing; and (e) means for closing said opening after insertion of the sheets into the opening and the dispensing aperture to insure dispensing of the sheets occurs primarily through the dispensing aperture, said closure means being independent of said plate and movable with respect to said plate.

21. A dispenser for the dispensing of individual sheets of a flexible and foldable sheet product from a center fed roll of such product, said dispenser comprising:

(a) a plate for receiving a roll of the sheet product in a selectable orientation;

(b) a dispensing aperture provided by said plate positioned with respect to said roll for receiving the sheets of the product and allowing a user to pull the same outwardly through the dispensing aperture;

(c) an elongate opening in said plate in communication with said aperture, said opening also being in communication with an edge of said plate such that a strip of the sheets may be inserted into the elongate opening and into the dispensing aperture; and (d) an aperture control element shiftable in said elongate opening to selectively control the size of the elongate opening and hence the size of the dispensing aperture and thereby allow for sheet material of different thickness.

22. A dispenser for the dispensing of individual sheets of a flexible and foldable sheet product from a center fed roll of such product, said dispenser comprising:

(a) a plate for receiving a roll of the sheet product in a selectable orientation;

(b) a dispensing opening provided by said plate positioned with respect to said roll for receiving the sheets of the product and allowing a user to pull the same outwardly through the opening;

(c) said opening in said plate being in communication with an outer edge of said plate allowing a long length of the sheets to be initially inserted from the outer edge of the plate and through the opening and into an inner end of the opening to start the feeding through the dispensing opening thereof;

(d) and closure means independent of said plate and movable with respect to said plate for closing said opening after insertion of the sheets into the opening to insure dispensing of the sheets occurs primarily through the inner end of the dispensing opening; and (e) means associated with said closure means to adjustably reduce or expand the size of the opening.

* * * * *